US005861714A

United States Patent [19]

Wei et al.

[11] Patent Number: 5,861,714

[45] Date of Patent: Jan. 19, 1999

[54] CERAMIC ENVELOPE DEVICE, LAMP WITH SUCH A DEVICE, AND METHOD OF MANUFACTURE OF SUCH DEVICES

[75] Inventors: George C. Wei, Weston, Mass.; Stefan Juengst, Zorneding, Germany; Rodrique G. Thibodeau, Marblehead; John Selverian, Beverly, both of Mass.

[73] Assignee: Osram Sylvania Inc., Danvers, Mass.

[21] Appl. No.: 883,939

[22] Filed: Jun. 27, 1997

[51] Int. Cl.[6] ..... H01J 17/18; H01J 61/36

[52] U.S. Cl. ..... 313/625; 313/572; 313/636; 220/21 R

[58] Field of Search ..... 313/625, 572, 313/573, 634, 636; 220/21 R

[56] References Cited

U.S. PATENT DOCUMENTS

| | | | |
|---|---|---|---|
| 4,155,758 | 5/1979 | Evans et al. | 75/232 |
| 4,354,964 | 10/1982 | Hing et al. | 252/518 |
| 4,431,561 | 3/1988 | Izumiya, et al. | 313/623 |
| 4,602,956 | 7/1986 | Partlow et al. | 75/235 |
| 4,687,969 | 8/1987 | Kajibara et al. | 313/625 |
| 4,780,646 | 10/1988 | Lanhe | 313/625 X |
| 4,825,126 | 4/1989 | Izumiya et al. | 313/25 |
| 4,988,916 | 1/1991 | Odell et al | 313/625 X |
| 5,075,587 | 12/1991 | Pabst et al. | 313/25 |
| 5,404,078 | 4/1995 | Bunk et al. | 313/625 |
| 5,552,670 | 9/1996 | Heider et al. | 313/612 |
| 5,637,960 | 6/1997 | Juengst et al. | 313/625 |

FOREIGN PATENT DOCUMENTS

| | | | |
|---|---|---|---|
| 0609477 | 2/1993 | European Pat. Off. | H01J 61/36 |
| 0650184 | 7/1993 | European Pat. Off. | H01J 61/36 |

OTHER PUBLICATIONS

The relationship between physical properties and microstructures of dense sintered cermet materials, Science of ceramics, vol. 9, pp. 135–142, P. Hing, Dec. 1977.

*Primary Examiner*—Ashok Patel
*Attorney, Agent, or Firm*—William H. McNeill

[57] ABSTRACT

This invention involves a new type of feedthrough-plug member for metal halide HID lamp using PCA envelopes. The construction of the lamp housing consists of a PCA envelope and specially designed axially graded alumina-metal cermet multi-layers to eliminate cracking in cermet or PCA due to thermal stresses arising from thermal expansion mismatch. The fills are metal halides such as Na—Sc—I, rare earth halides, Hg, Sn, and inert gases. The PCA vessel and directly sealed cermet-feedthrough assemblies allow the metal halide lamps to operate at high wall temperatures with better lumen output, color temperature, and CRI.

24 Claims, 12 Drawing Sheets

CERAMIC ENVELOPE DEVICE, LAMP WITH SUCH A DEVICE, AND METHOD OF MANUFACTURE OF SUCH DEVICES

FIELD OF THE INVENTION

The present invention relates to a ceramic envelope device, to a lamp with such a device, and more preferably to a metal halide lamp with a polycrystalline alumina envelope whose ends are closed by ceramic-like plugs. More particularly, it is directed to a device with at least one cermet plug having parts or zones or layers with gradually changing coefficients of thermal expansion. Moreover it relates to such cermet plugs themselves and the method for making the same.

BACKGROUND OF THE INVENTION

Metal halide high intensity discharge (HID) lamps are desired to run at high wall temperatures in order to improve the efficacy, alter the color temperature, and/or raise the color rendering index of the light source. Typically, the metal halide lamps include fills comprising halides (especially iodides and bromides) of one or more metals, such as Na. Often Na is used in combination with Sc or Sn. Further additions are Th, Tl, In and Li. Other types of filling include rare earth metals such as Tm, Ho and Dy. Lamps which contain such fills have very desirable spectral properties: efficacies above 100 lm/W, color temperatures of about 3700 K, and color rendering indices (CRI) around 85. Because of the low vapor pressure of some of the metal halide additives, the fused quartz lamp envelope must be operated at higher than normal temperatures. At wall temperatures exceeding 900°–1000° C., the lifetime of the lamps is limited by the interaction between the metal halides and the wall made from quartz glass. The use of arc tube materials which can be operated at higher temperatures than quartz glass and which are chemically more resistant than quartz glass provides an effective way to increase the lifetime of lamps containing these metal halides.

Polycrystalline alumina (PCA) is a sodium resistant envelope for high pressure sodium lamps. PCA can operate at higher temperatures than quartz glass and it is expected to be chemically more resistant than quartz glass. The PCA vessel is closed at its ends by means of alumina plugs. Gastight sealing is achieved by sealing glass, often referred to as fusible ceramic or frit. However, investigations of metal halide chemistries in PCA envelopes have shown that reactions between the metal halides and conventional frits or even allegedly "halide-resistant" frits severely limit lifetime. An example of such a frit is based on the components CaO, $Al_2O_3$, BaO, MgO and $B_2O_3$. Consequently, it is highly desirable to find a fritless seal method.

Normally, PCA lamps use feedthroughs made from niobium because their coefficients of thermal expansion are similar. Especially when the fill contains rare earth halides, one problem is involved by the reactions between the Nb feedthroughs and the fill. This problem was alleviated somewhat by using special arrangements wherein the plug and the feedthrough is simultaneously replaced by a plug made from electrically conductive cermets. These cermets are composite sintered bodies usually comprising alumina (the arc tube material) and molybdenum (Mo) or tungsten (W), both metals being halide resistant materials.

U.S. Pat. No. 4,354,964, Hing et al., discloses an electrically-conducting alumina-metal (e.g. tungsten or molybdenum) cermet containing 4 to 20 vol. % metal for use as plug members or feedthroughs in PCA (polycrystalline alumina) envelopes of metal halide HID (high-intensity discharge) lamps. The cermet has refractory metal rods (as electrodes or current leads). They are embedded in the cermet body in the green or prefired state and then co-fired during final sintering of the cermet to high density. The method of joining such cermets with PCA tubes is not described. Thermal expansion mismatch between the cermet and PCA, or between the cermet and tungsten or molybdenum electrode can not be eliminated simultaneously. Such differential thermal expansion can result in cracking and leaks in either PCA tubes or cermet, or in both, during lamp on-and-off operation.

U.S. Pat. No. 4,731,561, Izumiya et al., shows one end of the PCA tube that is closed with a co-sintered electrically-conductive alumina-Mo or W cermet. The other end of the PCA tube is enclosed with a frit-sealed cermet. The cermets are all coated with an insulating layer so as to prevent back-arcing.

U.S. Pat. No. 4,687,969, Kajihara et al, describes besides conducting cermet plugs also non-conducting cermets with feedthroughs passing through and projecting in- and outwardly. One end of the PCA tube has a co-sintered cermet, while the other end has a frit-sealed cermet. However, cracking in the cermet can not be prevented, since the composition of the plug is fixed and is not direction dependent.

All these one-part plugs have the disadvantage that their coefficient of thermal expansion does not really fit the surrounding part (e.g. the vessel). A solution is suggested for example in U.S. Pat. No. 4,602,956, Partlow et al. It discloses a cermet plug that comprises a core, consisting essentially of 10 to 30 volume percent W or Mo, remainder alumina, and one or more layers of other cermet compositions surrounding the core and being substantially coaxially therewith. The layers consist essentially of from about 5 to 10 volume percent W or Mo, the remainder alumina. Such a cermet plug is hermetically sealed to the end wall of the arc tube by means of "halide-resistant" frits.

However, electrically conductive cermet plugs are not sufficient gastight over a long time due to their fine structure.

Another solution is a non-conductive cermet plug having a more dense structure. Consequently, a separate metal feedthrough is needed. U.S. Pat. No. 5,404,078, Bunk et al., discloses a high pressure discharge lamp with a ceramic vessel whose ends are closed by non-conductive cermet plugs consisting for example of alumina and tungsten or molybdenum. In a specific embodiment (FIG. 9) the cermet plug consists of concentric parts with different proportions of tungsten. These parts provide gradually changing coefficients of thermal expansion.

European Patent Application No. 650 184, Nagayama, discusses an arc tube with end plugs consisting of a non-conducting cermet. The cermet plug is made from axially aligned layers of different composition (axially graded seal, see FIG. 16 et seq.). The first layer of the plug is integrally attached to the open end of the vessel. The metal feedthrough is a tungsten-based rod. The sealing between the feedthrough and the last axially aligned layer of the plug is performed by a rather complicated technique. It uses

- a threaded portion of the feedthrough being in direct contact with the last layer of the plug,
- an outer metal disc ("flange") in contact with the outer surface of the last layer
- and a sealant such as platinum or glass solder covering the flange and the outer surface of the last layer.

One of the rods acting as a feedthrough has an axial hole therein for inserting the fill into the discharge vessel.

U.S. Pat. No. 4,155,758, Evans et al., discloses in FIG. 14 an axially graded plug, too. However, it is made from three layers of electrically conducting cermet.

DISCLOSURE OF THE INVENTION

It is an object of the invention to provide a ceramic envelope device for a high pressure discharge lamp, especially for a metal halide lamp with a very long lasting gas-tight seal. A further object is to provide a lamp made from such a device. A further object is to provide a method of manufacture for such a device.

Briefly, this object is achieved by a ceramic envelope device with the following features:

- a translucent ceramic tube having a first end and a second end, said tube defining a longitudinal axis, and said tube confining a discharge volume
- a first at least essentially electrically non-conducting cermet end plug, said first plug closing said first end of the ceramic tube
- a second at least essentially electrically non-conducting cermet end plug, said second plug closing said second end of the ceramic tube
- at least said second plug having a multipart structure with at least three parts
- a first and second metal feedthrough passing through the first and second plug respectively, each feedthrough having an inner end and an outer end, respectively, said feedthroughs being made from one of the group of the metals tungsten, molybdenum and rhenium and alloys from at least two of these metals
- two electrodes located at the inner end of the first and second feedthrough respectively
- the coefficient of thermal expansion of at least one part of the multipart plug being between those of the arc tube and the feedthrough
- wherein said multipart plug is a structure that comprises at least four axially aligned parts with different coefficients of thermal expansion, including a first and a last part, the first part being innermost with respect to the discharge volume and the last part being outermost with respect to the discharge volume
- the multipart plug is directly sintered both to the arc tube and the feedthrough in that manner that the innermost part of the plug is directly sintered to the arc tube and the outermost part of the plug is directly sintered to the feedthrough.

Preferably, the difference between the coefficients of thermal expansion for all adjacent parts (including the tube and the related feedthrough) is less than $1.0\times10^{-6}$/K. This minimizes thermal stresses and cracks.

The second feedthrough is usually a tube or pipe, said second feedthrough being in contact with the multipart structure. However another embodiment of the second feedthrough is a pin or rod, preferably when a separate filling bore is used.

The first feedthrough can be a rod in combination with a one-part-plug (as well known) or it can be similar to the second feedthrough. Accordingly, the first plug can be a one-part body or a multi-part structure.

The features outlined above work together as follows: The graded cermet end plug comprises parts or zones or layers with slightly different coefficients of thermal expansion. The coefficients decrease from the outermost part of the plug to the innermost part of the plug. Outermost part means the part that is axially most distant from the discharge volume. Innermost part means the part that is axially closest to the discharge volume.

The innermost zone has an outer surface (seen in radial direction) which is in contact either with the inner wall of the end of the alumina arc tube or with a separate alumina insert member. Its thermal expansion matches well with the thermal expansion of the alumina arc tube or insert member, respectively. On the other hand, the thermal expansion behavior of the outermost zone matches good to the feedthrough. The inner surface of the outermost zone (in radial direction) is in contact with the feedthrough. The intermediate parts of the plug serve as transition zones which gradually bridge the difference in the coefficients of thermal expansion of the innermost and outermost zone or part.

Preferably, not all intermediate parts are in contact with the feedthrough. This can be accomplished in two different ways. The first is that the inner diameter of the intermediate parts is bigger than that of the outermost parts. A more elegant solution which is easier to manufacture is that all parts have the same inner (and even the same outer) diameter. However the feedthrough penetrates only some of the outer parts (up to three). It must not penetrate the inner parts which are not thermally adapted.

Another important feature is that the over all length of the multipart structure is as short as possible (preferably below 5 mm) because it is only then that a homogeneous and uniform density of the structure is achievable.

The different features of the different zones can be achieved by mixing different amounts of metal powder (preferably tungsten or molybdenum) to the alumina powder at the beginning of the cermet preparation. Surprisingly, a plug comprising tungsten in combination with a molybdenum feedthrough is most promising.

There are several possibilities to provide the parts of said plug with different coefficients of thermal expansion:

One way is that the composition of the different parts comprises alumina as a first component and a metal, preferably tungsten or molybdenum, as a second component. The compositions of the parts differ in the proportion of the metal added to alumina. Another way of achieving this aim is, that the compositions of the different parts use different constituents, for example aluminum nitride and aluminum oxynitride. Whereas the coefficient of thermal expansion of aluminum nitride has a given value (see for example U.S. Pat. No. 5,075,587), the coefficient of aluminum oxynitride depends on the proportions between its constituents, namely alumina and aluminum nitride. The situation is similar to a cermet made from the constituents alumina and one of the metals tungsten or molybdenum.

In a preferred embodiment, the plug is formed like a cylindrical disc and made from concentric parts having the same outer diameter (with the possible exception of the innermost part) and with axially graded coefficients of thermal expansion.

Instead of stepwise changing thermal features of the parts of the plug it is also possible that the coefficient of thermal expansion of the plug changes smoothly in axial direction. Another imagination of this embodiment is that the number of parts is infinite.

In another preferred embodiment the plug is a layered cylindrically shaped structure with a central bore. The bore can have a constant or varying diameter. Only the outermost layer adjacent the feedthrough is in gas-tight contact with the feedthrough. The other layers are distant from the feedthrough. The radially seen outer surface of the innermost layer is in contact with the vessel end.

In order to avoid capillary effects in this embodiment it is advantageous that the distance between the feedthrough and the layers of the plug—except the outermost layer which is in contact with the feedthrough—is at least 1 mm. This distance may be the same for all layers.

Of special importance is the distance between the innermost layer of the plug and the feedthrough. It is preferably at least 3 mm. This allows for placing the electrode into this volume.

An advantageous structure is a telescope-like multipart plug, wherein the distance between the parts or layers and the feedthrough decreases stepwise from the innermost to the outermost layer.

In an especially preferred embodiment the multipart plug is a layered cylindrically shaped structure with constant inner and outer diameter. It consists of four or five zones. The feedthrough is a pipe which penetrates the outermost part and possibly the adjacent intermediate parts but not the inner parts neighboring the discharge. The innermost part is either in contact with the vessel end or with a ceramic insert member, that is typically annular and has a composition similar or identical to the vessel. It is advantageous that the multipart structure is recessed in the insert member. A typical value is 0.5 mm.

The advantage of the concept of an axially graded seal is that the temperature load of the seal is minimized and gas-tightness is optimized, when only a small portion of the plug, preferably the innermost layer, is located in the end of the arc tube. Optionally the innermost layer either is fully enclosed in the end of the arc tube or is only partially enclosed in it.

The "seal" length between the innermost layer(s) and the vessel end is at least 0.8 mm. Typical values are between 1 and 2 mm. A similar seal length is preferred between the outermost layer(s) and the feedthrough.

The inventive cermet consists of an alumina matrix wherein metal particles (preferably molybdenum or tungsten) are embedded. These particles are at least approximately ball-shaped. It turned out that the different thermal expansion behavior of the alumina matrix and the metal particles is a critical feature.

The average thermal expansion of alumina-tungsten cermet as a function of the amount of tungsten is known, see for example "The Relationship between Physical Properties and Microstructures of Dense Sintered Cermet Materials", P. Hing, pp. 135–142, Science of Ceramics. ed. K. J. de Vries, Vol. 9, Nederlandse Keramische Verenigung (1977). Accordingly the proportion of tungsten required for a given thermal expansion can be determined.

It turned out that microscopic stresses develop in the alumina matrix at the interface to the tungsten particles. Said stresses decrease with decreasing size of the minority partner. The minority partner is often referred to as dispersoid or dispersed phase. For some zones, this minority partner is alumina, for other zones it is metal (tungsten).

Therefore, a very fine particle size for the tungsten powder is preferred, at least for alumina-tungsten cermet containing <50 vol.-% of W. Typical values for the average particle size are 0.6 to 0.9 $\mu$m.

In practice, tungsten precursors such as ammonium tungstate that is soluble in water can be used to produce very fine particles of tungsten in a matrix of alumina. Tungsten precursors can be dissolved in water, mixed with alumina powder, and calcined to convert to fine tungsten particles. A similar technique was used in making a nanophase WC—Co composite powder, see "Characterization and Properties of Chemically Processed Nano-phase WC—Co Composites", L. E. Mc Candlish, B. K. Kim, and B. H. Kear, p. 227–237, in: High Performance Composites for the 1990s; ed.: S. Das, C. Ballard, and F. Marikar, TMS, Warrendale, Pa., 1991.

Conversely, at least for alumina-W cermet containing >50 vol.-% W, precursors of alumina (soluble in water) such as aluminum nitrate can be used to result in very fine alumina particle size. Typical values for the average particle size are 0.4 to 0.9 $\mu$m.

It is important to select the appropriate starting materials for the manufacture of the cermet to achieve (1) a uniform distribution of the dispersed phase, (2) a fine particle size of the dispersed phase, (3) a green density and firing shrinkage compatible with the neighboring layers, in order to produce graded cermets free of cracks or distortion, (4) a green density and firing shrinkage behavior so as to form a direct bond between metal feedthrough and cermet plug, and between cermet plug and PCA arc tube, respectively.

Typical ranges for the dimensions of such cermet plugs are:

outside diameter: 3.0 to 4.0 mm (with the proviso that possibly the first part has a greater diameter), length over all of the axially graded plug: up to 10 mm, preferably below 5 mm, The axial thickness of the innermost zone is preferably between 1.0 and 3.0 mm. The axial thickness of each intermediate zone including the outermost zone is preferably between 0.3 and 1.5 mm.

The feedthroughs are preferably tubular. They are tubes having dimensions of the following typical ranges:

outer diameter between 0.9 and 1.6 mm inner diameter between 0.6 and 1.2 mm over all length between 10 and 15 mm wall thickness is at most 0.25, preferably around 0.1 mm.

It is of advantage that the outermost part or zone or layer contains more than 50 vol.-% metal. Such an high metal content allows for welding this part to the related feedthrough in addition to the direct sintering between these two bodies. Thus the bonding between the two bodies is improved by using the additional welding as a safety measure in case the portion of direct sintering becomes leaky.

In an especially preferred embodiment of reduced temperature load the multipart structure is located in a certain distance from the hot discharge volume and an additional hollow cylindrical member (preferably an alumina capillary) is located between the vessel end and the multipart structure. This arrangement can reduce the operating temperature of the multipart structure by about 200° C. A gas tight connection between the hollow member (capillary) and the multipart structure is preferably achieved by means of a bushing element surrounding the contact zone of the two members.

In a preferred embodiment the concept of the axially graded plug allows for a special filling technique using a separate filling bore in the second, multipart plug for evacuating and filling the discharge vessel. In this embodiment the diameter of the filling hole or bore is not confined by the diameter of the tubular feedthrough. The bore is axially aligned but eccentric positioned with respect to the axis. The bore is closed off after filling by means of an adapted rod (hereafter referred to as a stopper). Thus the discharge vessel is capable of resisting corrosion and changes of temperature. Lamps with such plugs have a very good long-time gastightness and an excellent maintenance. The reason is that not only the plug is bonded to the end of the discharge vessel and to the feedthrough without any glass frit or ceramic sealing material, but also said stopper closes the filling bore without any of these materials. This is possible by a very tricky arrangement:

The important feature is that the outermost cermet layer or part of the plug has a composition that enables it to be welded. To fulfill this requirement a proportion of metal more than 50 vol.-% is requested for the outermost layer. This layer can be, but does not necessarily have to be electrically conducting.

During manufacture of the arc tube device the first part of the plug is joined to the arc tube by co-firing as previously described. Once the cermet plug is co-fired to the end of the arc tube, the discharge volume is pumped, flushed and filled through the fill hole. The stopper is then inserted into the filling hole and is then welded to the cermet plug at the outer surface of the outermost part. Thus a hermetic bonding is achieved.

The rod or stopper can be made of metal (preferably molybdenum or tungsten) or cermet material. Preferably it is made from the same material as the outermost layer of the plug.

Any standard welding technique can be used, e.g., resistance welding, laser welding, electron beam welding or tungsten inert gas (TIG) welding.

Thus the plugs under investigation are very often strictly electrically non-conducting. In a favorable special embodiment a plug can be used with an outermost layer of high metal proportion. Optionally this layer can be made from electrically conducting cermet. At most the adjacent layer (last intermediate layer) is also electrically conducting—in contrast to all other layers being nearer to the discharge volume and being electrically non-conducting. Such an arrangement is called herein an "essentially non-conducting plug".

The main advantages of this invention, being a breakthrough in sealing technique, are as follows:

There is absolutely no frit in the seal, but nevertheless a well established and very reliable sealing technique, direct sintering, can be used.

The fill hole can be large enough to permit easy pumping and filling.

This type of sealing works for any wattage of the lamp and for any size of the discharge vessel.

It is worth mentioning that a preferred composition of the discharge vessel is PCA doped with magnesia and possibly yttria or zirconia. This composition is also preferred for the hollow and the bushing element referred to above. In contrast the preferred composition for the alumina powder of the multipart structure is either pure alumina (which is preferred for the outer zones with high tungsten proportion) or alumina doped with magnesia (which is preferred for the inner zones with low tungsten proportion).

The invention is further illuminated by way of examples.

BEST MODE FOR CARRYING OUT THE INVENTION

Figure 1:
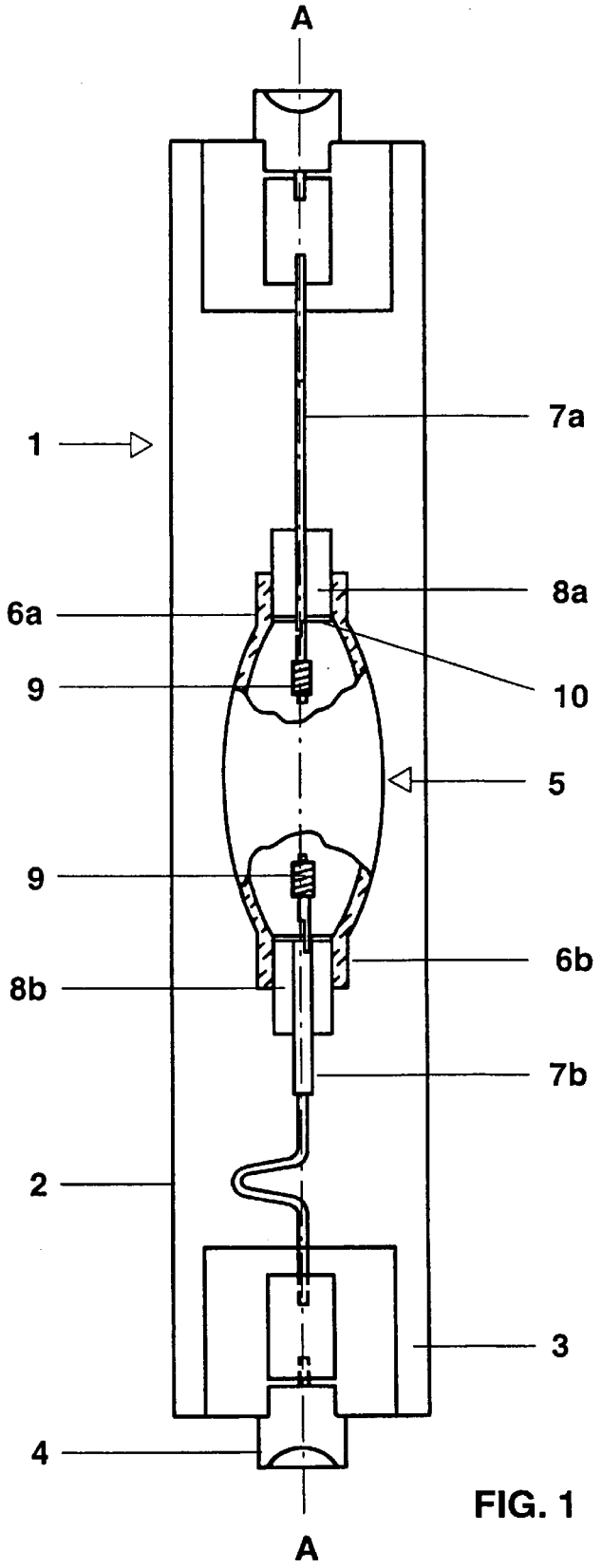
FIG. 1 is a highly schematic view of a lamp with a ceramic arc tube, partly in section.

Referring first to FIG. 1 which, for purpose of illustration, shows in highly schematic form a metal halide discharge lamp 1 with a power rating of 150 W. The lamp has an essentially cylindrical outer envelope 2 made of quartz glass, which is pinch sealed at its ends 3 and supplied with bases 4. A ceramic envelope device 5 acts as a discharge vessel or arc tube that is enclosed within the outer bulb 2. The ceramic arc tube device 5 defining a central longitudinal axis A having two ends is made from alumina. It is formed, for example, as a cylindrical tube (not shown) or it may be bulged outwardly in the center, as shown. It is formed with cylindrical end portions 6*a* and 6*b* at the two ends. Two current feedthroughs 7*a*, 7*b* are fitted, each, in a ceramic-like (cermet) end plug 8*a*, 8*b*, located in the end portions 6*a* and 6*b*.

The first current feedthrough 7*a* is a molybdenum pin which is directly sintered into the first end plug 8*a* located in the first end portion 6*a*. The plug is a one part ceramic-like body consisting of composite material (alumina and tungsten) as already known for example from EP-A 609 477.

The second current feedthrough 7*b* is a molybdenum tube which is directly sintered into the second end plug 8*b* located in the second end portion 6*b*, which is a multipart plug. Electrodes 9 are located at the inner tip of the feedthroughs 7*a*, 7*b*.

It is advantageous to apply an insulating coating 10 such as pure alumina to the inside surface of the cermet end plugs 8*a* and 8*b* so as to prevent arcing between the plasma column of the arc discharge and the cermet plugs 8*a* and 8*b*, that can cause darkening and leakage.

The arc tube 5 encloses a fill which includes an inert ignition gas, for example argon, as well as mercury and additives of metal halides, for example rare earth iodides.

During manufacture of the lamp the second, tubular feedthrough 7*b* acts as a pump and fill opening used to evacuate and then to fill the arc tube 5. This technique is well known (see citations above). It is only then that the feedthrough 7*b* is closed.

Figure 2:
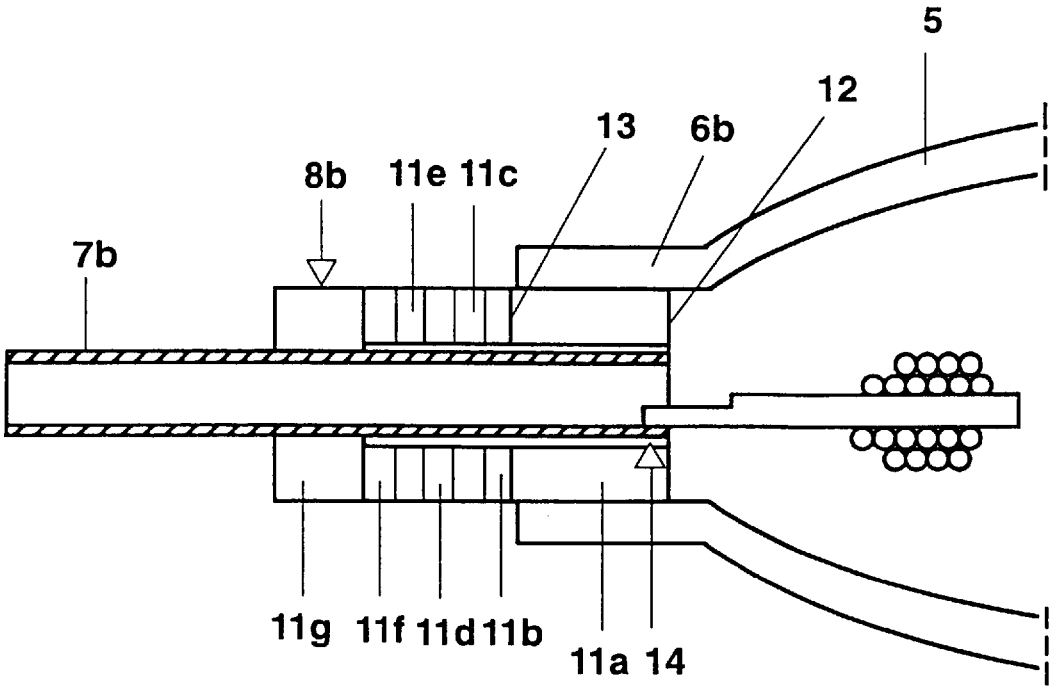
FIG. 2 is a detailed view on the first end of the arc tube, showing a first embodiment of the invention.

FIG. 2 is a detailed view on the second end 6*b* of the arc tube 5. It illustrates that the cermet end plug 8*b* consists of seven ring-like parts or zones 11*a*–11*g* which are axially aligned, one behind the other. The first, innermost zone 11*a* faces with its inner surface 12 to the discharge volume. Its outer surface 13 faces to and contacts the inner surface of the adjacent first intermediate zone 11*b*. Innermost zone 11*a* is made from pure alumina. The adjacent first intermediate zone 11*b* is made from 15 vol.-% tungsten, balance alumina. The composition of the further zones follows the principles outlined above. The proportion of tungsten (W) increases towards the outermost zone. Zone 11*c* has 22% tungsten, zone 11*d* has 27% tungsten, Zone 11*e* has 32% tungsten, Zone 11*f* has 37% tungsten, Zone 11*g* has 40% tungsten.

Generally speaking, in case of seven zones the preferred ranges for the composition of the zones are as follows:

innermost ring zone 11*a* (first layer): 100 vol.-% alumina adjacent intermediate zone 11*b:* 10 to 20% W, balance alumina second intermediate zone 11*c:* 20 to 25% W, balance alumina third intermediate zone 11*d:* 25 to 30% W, balance alumina forth intermediate zone 11*e:* 30 to 35% W, balance alumina fifth intermediate zone 11*f:* 35 to 40% W, balance alumina outermost ring zone 11*g* (last layer): 40 to 43% W, balance alumina.

The thermal behavior of the outermost ring zone 11*g* matches that of the molybdeum tube 7*b* which acts as feedthrough. Ring zone 11*g* is directly sintered to the molbdyeum tube 7*b*. In contrast, the other zones 11*a*–11*f* do not touch molybdenum tube 7*b*. A small gap 14 which is about 50 $\mu$m wide remains between the tube 7*b* and the plug zones 11*a*–11*f*.

Figure 3:
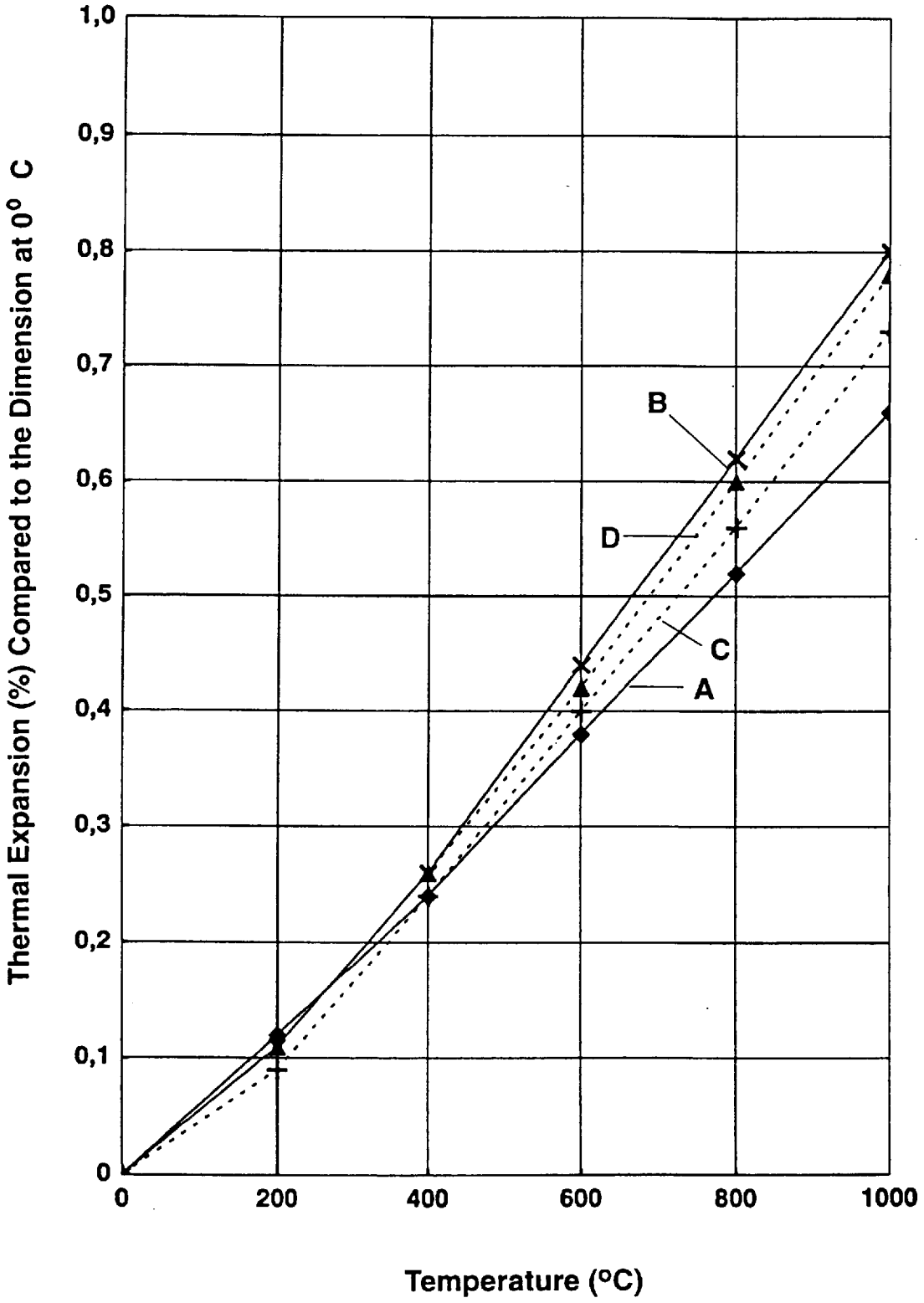
FIG. 3 is a diagram showing expansion versus temperature for different cermet parts.

FIG. 3 shows the absolute degree of thermal expansion (in percent compared to 0° C.) versus temperature of the tubular feedthrough 7*b* (molybdenum, curve A), of the outermost ring zone 11*g* (alumina; curve B), and of two intermediate layers (alumina with 30% tungsten; curve C; and alumina with 20% tungsten; curve D). It is a special trick to use a cermet comprising tungsten as the metal component in combination with a feedthrough made from molybdenum. Tungsten has a markedly lower coefficient of thermal expansion thanmolybdenum. Hence accommodation of the desired features of the ring zones is easier by adding tungsten to the alumina since in comparison to molybdenum smaller amounts of tungsten are sufficient to reach the desired thermal coefficient of a special zone.

Figure 4:
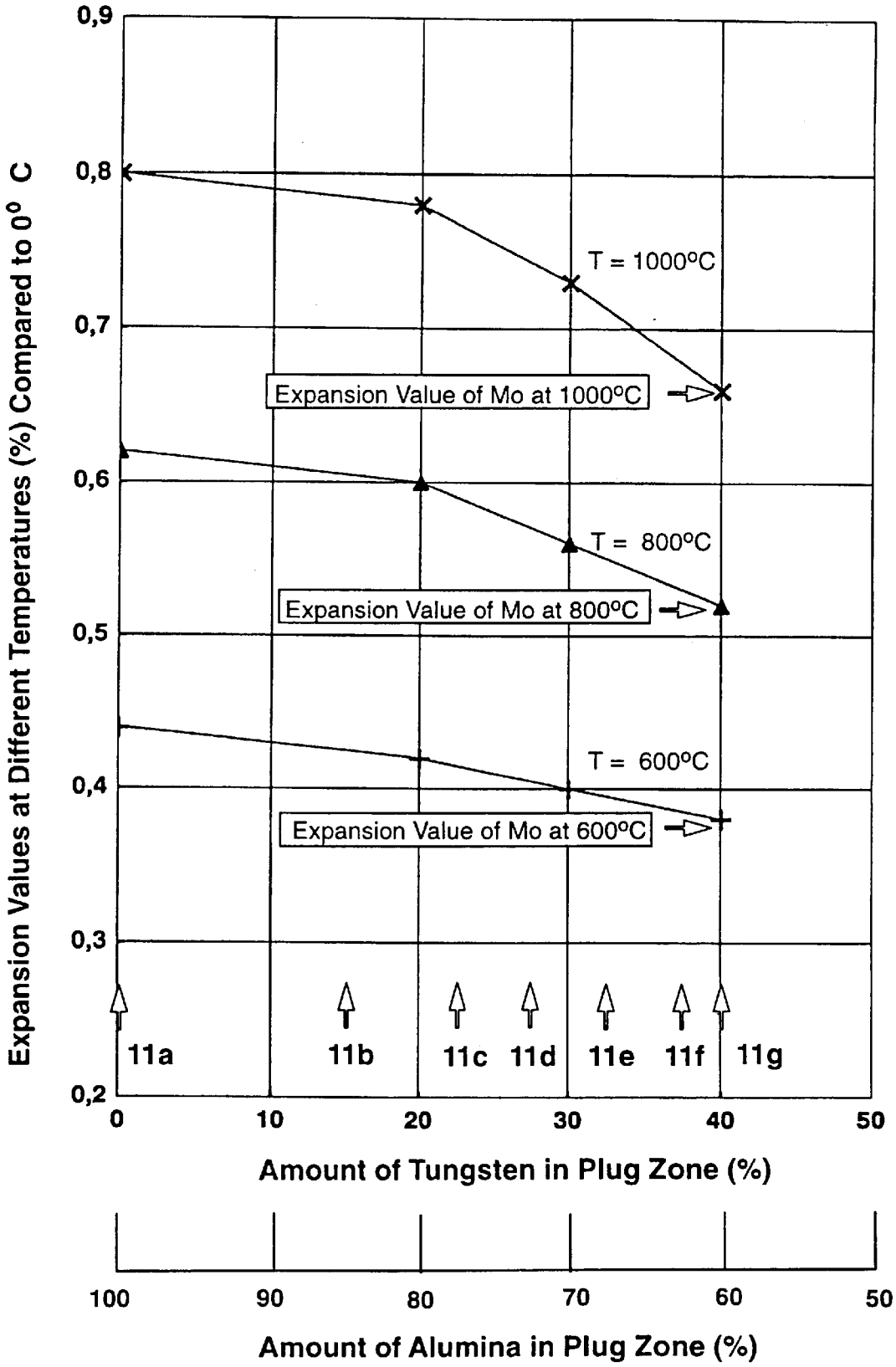
FIG. 4 is a diagram showing expansion values at different temperatures for different proportions of tungsten in the cermet part.

FIG. 4 illustrates the absolute degree of thermal expansion (in percent compared to 0° C.) at different temperatures T versus tungsten proportion for different cermet end plug zones. It shows that an about 40% tungsten proportion (balance alumina) has similar thermal features like a pure molybdenum feedthrough (arrows) under high temperatures. The difference in absolute expansion between adjacent ring-like zones is very small. The six zones 11*a*–11*g* are indicated by arrows.

Figure 5:
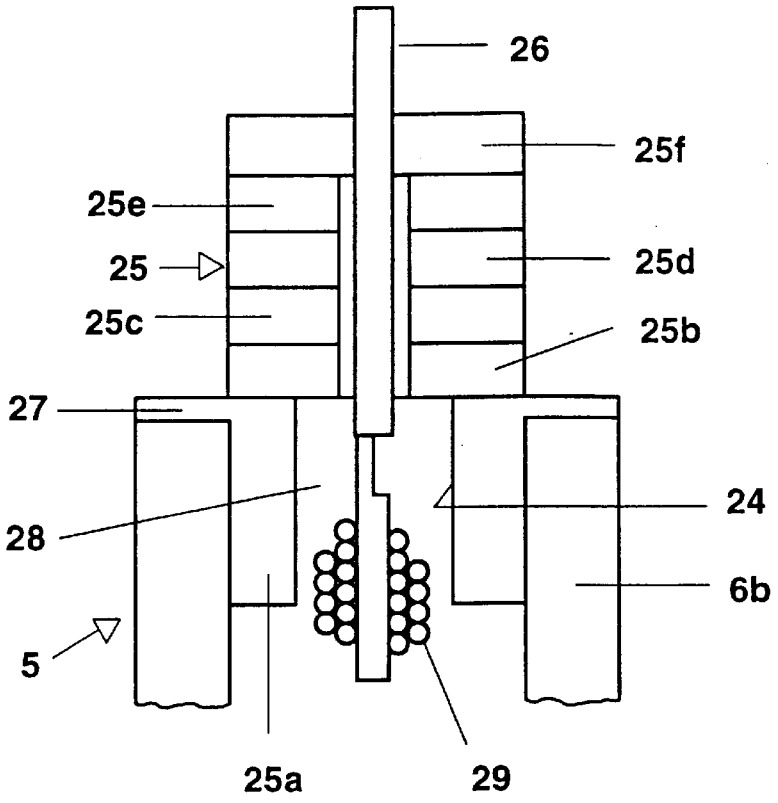
FIG. 5 is a detailed view on the second end of the arc tube, showing a second embodiment of the invention.

A second example of an axially graded seal embodiment is shown in FIG. 5. The end plug or end closure member 25 consists of six parts 25*a*–25*f*. Again, the outermost part 25*f* of the end plug 25 is directly bonded to the molybdenum-made tubular feedthrough 26, whereas the innermost part 25*a* is directly sintered to the end portion 6*b* of the polycrystalline alumina (PCA) arc tube. The innermost part 25*a* has a top hat structure. This means that it is inserted in the vessel end 6 *b,* but a radially further extending rim 27 is sitting on the outer surface of the end portion 6*b*. The distance between the inner radial surface 24 of part 25*a* facing the feedthrough 26 and the feedthrough 26 itself is about 5 mm. This ring-shaped volume 28 inside the first plug zone surrounds the electrode 29. The intermediate parts 25*b*–25*e* leave only a small ring-shaped capillary or gap of about 100 $\mu$m to the feedthrough 26.

Bonding of a "top hat"-type configuration used for the innermost ring zone 25*a* is as follows: First, the cermet end plug 25 and the feedthrough 20 are prefired together and thus an assembly is created. It is then mounted on the second open end 6*b* of a PCA tube (prefired or already sintered to translucency), and the entire assembly is brought up to high temperatures to form a bond between the outermost ring layer 25*f* and the metal feedthrough 26 (tungsten or molybdenum ), and between the innermost ring layer 25*a* and the end portion 6*b* of the PCA tube, simultaneously.

Generally speaking, the cermet plug or end enclosure member 25 is a layered, cylindrically-shaped structure with a center hole occupied by a Mo or W tubular (or in another embodiment rod-like) feedthrough 26, which in turn is axially connected to an axially located Mo or W electrode 29 (inside the arc tube) and a current lead (outside the arc tube). The cermet hollow cylinder consists of multilayers of cermet in which the alumina-to-metal volume ratio increases in the axial direction projecting inward. The concentration of the metal phase increases from a low level content in the first, innermost (bottom) layer 25*a* (adjacent to the discharge volume) to an almost 100% in the last, outermost (top) layer 25*f* (most remote from the discharge volume). The top layer of the cermet (containing a high level of metal phase) is direct-bonded (bonded by direct sintering) to the feedthrough 26, while the first, bottom layer 25*a* of the cermet which is essentially alumina (containing a very low level of metal phase) is direct-bonded to PCA arc tube, which preferably is either elliptically shaped or straight cylindrically shaped. These two sinter-connections (direct bonds) achieve hermeticity as well as nearly perfect thermal expansion matches with both the metal feedthrough and the PCA tube.

The specific example of FIG. 5 has a six-layer structure. The thermal expansion coefficients of the cermet parts or layers 25*f*–25*a* (from top to bottom) are designed to be 5.0, 5.5, 6.0, 6.5, 7.0, $7.5\times10^{-6}$/°C. The top layer 25*f* matches nearly exactly the thermal expansion of the pure tungsten feedthrough 26 ($4.8\times10^{-6}$/°C.), and the bottom layer 25*a* is rather near to the thermal expansion of the end portion 6*b* of the PCA tube ($8\times10^{-6}$/°C.). The axial thickness of each part or layer 25 *b*–25*e* can be as thin as 0.2 mm in the sintered state if a layer-by-layer stacking technique is used. Using a spraying technique, the layer thickness can be reduced to 0.01 mm, see "Recent Development of Functionally Gradient Materials for Special Application to Space Plane", R. Watanabe and A. Kawasaki, pp. 197–208, Composite Materials, ed. A. T. Di Benedetto, L. Nicolais, and R. Watanabe, Elsevier Science, 1992.

The axial thickness of the top and bottom layers 25*f,* 25*a* should be about the wall thickness (0.5–0.8 mm) of the arc tube 5 so as to provide a long enough contact zone to the end portion and feedthrough , respectively. This is favorable for yielding a durable fritless bond. The designed thermal expansion coefficients of the layers correspond to the following volume percentages of W (from the top to the bottom layer): 70, 52, 38, 24, 15, and 6 vol.-%. The respective weight percents of W are 92, 84, 75, 60, 45, and 25 wt.-%.

In other embodiments the plug is subdivided into even more parts, zones or layers. Thus, the difference in thermal expansion behavior between adjacent parts becomes even smaller. The number of parts can be increased to ten, twelve, or even more layers.

Figure 6:
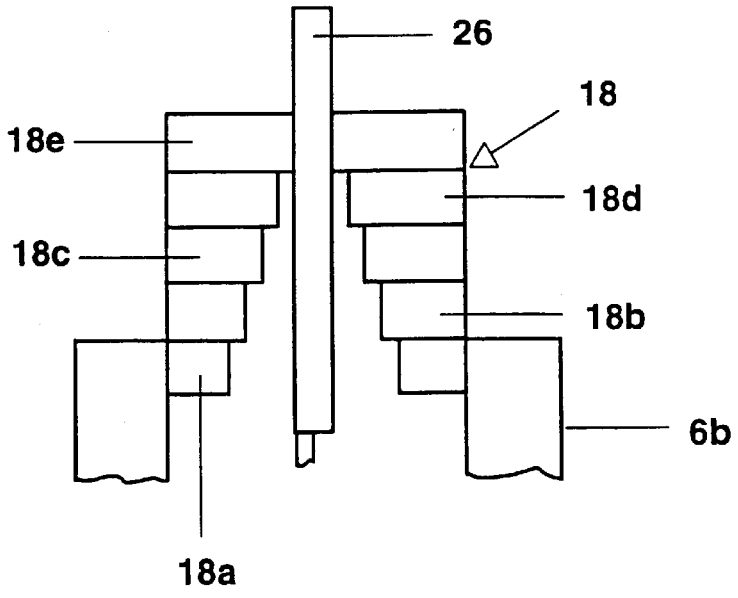
FIG. 6 is a detailed view on the second end of the arc tube, showing a third embodiment of the invention.

In a further preferred embodiment (FIG. 6) the layers or zones of the plug 18 are arranged telescope-like. This means that the distance between each zone and the feedthrough 26 decreases stepwise from the innermost zone 18*a* to the last intermediate zone 18*d*. The outermost zone 18*e* is again directly sintered to the feedthrough 26.

In this embodiment, the feedthrough 26 is made from molybdenum. The outermost layer 18*e* is made from an AlN layer (with a coefficient of thermal expansion of 5.7×10–6/°C., close to that of molybdenum, 5.0×10–6/°C.) which is adjacent to the molybdenum feedthrough 26. The innermost layer 18*a* and the intermediate or transitional layers 18*b*–18*d* between the AlN layer 18*e* and the end portion 6*b* of the PCA tube are made from aluminum oxynitride with varying proportions of alumina and aluminum nitride. The thermal expansion of aluminum oxynitride depends on the nitrogen content, and is known, for example, as being 7.8×10–6/°C. for 5 AlN.9 $Al_2O_3$.

An even more promising embodiment takes advantage from the fact, that AlN is known to be compatible with molybdenum, and AlN—Mo cermet is reported ("Thermomechanical Properties of SiC—AlN—Mo Functionally Gradient Composites", M. Tanaka, A. Kawasaki, and R. Watanabe, Funtai Oyobi Funmatsu Yakin, Vol. 39 No. 4, 309–313, 1992). Accordingly, the outermost layer in contact with the feedthrough is made from an AlN—Mo cermet instead of pure AlN. The first intermediate layer adjacent to the outermost layer is made from pure AlN or from a cermet with, different proportion between AlN and molybdenum.

In a further embodiment the cermet zones consist of alumina and non-metal components such as metal carbides and metal borides. Examples of such components are tungsten carbide and tungsten boride, see U.S. Pat. No. 4,825,126, Izumiya et al.

In another preferred embodiment for a 35 W lamp (FIG. 7), the arrangement is similar to FIG. 2. The second plug 32 consists of four non-conducting zones 32 *a–d,* axially positioned one behind the other. Since the amount of tungsten in the outermost layer 32*d* (60 vol.-%) is high enough for welding, a weld 33 is made at the outer surface of the last layer connecting the molybdenum tube 34 to the last layer 32*d*.

Typical dimensions for an axially graded seal are given for a 35 W metal halide lamp as follows:

The arc tube has a length of 14 mm. Each end is closed by a plug with a overall length of 5 mm. The plug consists of four axially aligned zones with 70 wt.-% tungsten, 50 wt.-% tungsten, 30 wt.-% tungsten, and 10 wt.-% tungsten. The bottom zone or part is partially inserted into the tube end by 2 mm. The first end has a molybdenum rod with a diameter of 0.3 mm and a overall length of 16 mm as feedthrough, the second end has a molybdenum tube with an outer diameter of 1.0 mm and an inner diameter of 0.8 mm as the feedthrough. Only the second end is provided with a graded seal plug whereas the first end uses a homogeneous plug whose components are identical with those of the bottom part of the graded seal plug. This bottom part has 10 wt.-% tungsten, balance alumina.

The hermeticity of the metal-cermet-bond is based on the formation of a solid-solution layer.

In an especially preferred embodiment (FIGS. 8*a* and 8*b*) the second plug 35 consists of four axially graded layers. The innermost layer 35*a* comprises 10 vol.-% (and more generally spoken 5–15 vol.-%) molybdenum, the balance being alumina. This first layer 35*a* is inserted into the second end 6*a* of the discharge vessel and directly sintered to it. The first intermediate layer 35*b* comprises 30 vol.-% (and more generally spoken 25–35 vol.-%) molybdenum, the balance being alumina. The second intermediate layer 35*c* comprises 45 vol.-% (and more generally spoken 40–50 vol.-%) molybdenum, the balance being alumina. The outermost layer 35*d* comprises 65 vol.-% (and more generally spoken more than 60 vol.-%) molybdenum (or tungsten), the balance being alumina. The axially located feedthrough 36 is a molybdenum rod having a diameter of 300 μm. A lateral positioned filling hole 37 in the plug 35 is parallel to the feedthrough 36. The filling hole has a diameter of 650 μm.

Figure 8A:
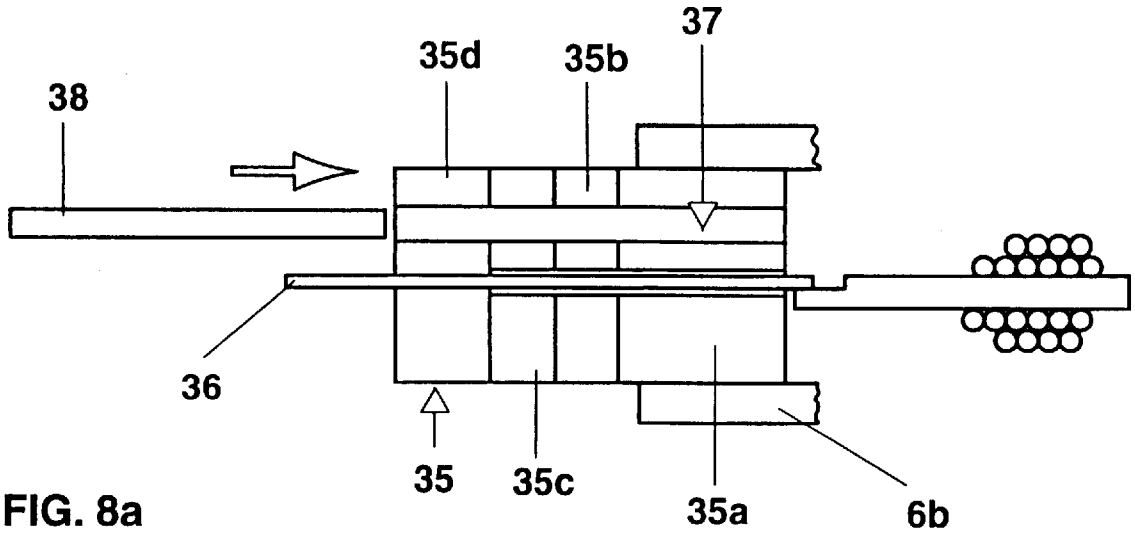
FIG. 8 is a detailed view on the second end of the arc tube, showing a fifth embodiment of the invention.
Figure 8B:
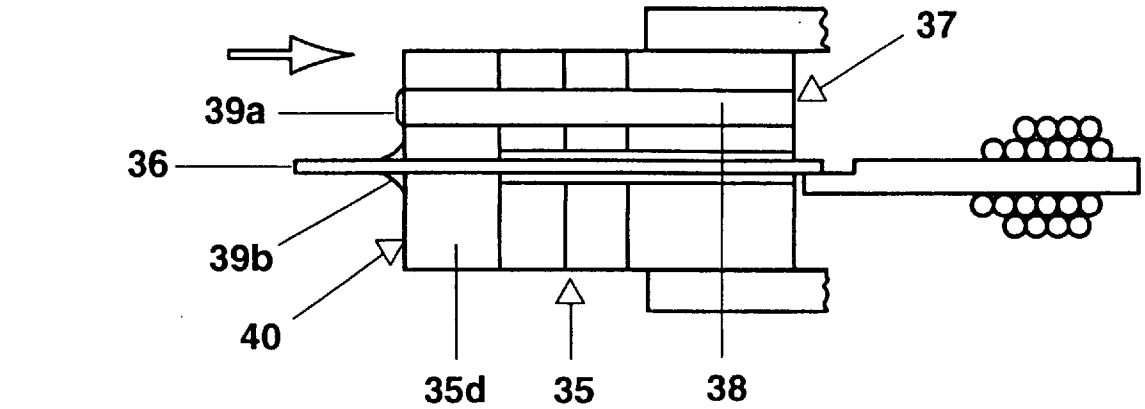

FIG. 8*a* illustrates the situation after evacuation of the discharge volume and insertion of the filling ingredients. The rodlike stopper 38 whose length is about the complete axial length of the plug 35 is ready for insertion into the hole 37. The stopper 38 is preferably made from molybdenum or from a cermet which contains a high amount of molybdenum or tungsten. Most preferred is a stopper having the same composition as the outermost plug layer 35*d*.

After insertion (FIG. 8*b*) of the stopper 38 into the hole 37 a welding connection 39*a* is performed between the outer end of the stopper and the outer surface 40 of the outermost plug layer 35*d*. Additionally, a similar welding connection 39*b* is performed between the outer end of the feedthrough 36 and the outer surface 40 of the outermost plug layer 35*d*.

The manufacture of the plug starts with preparation of the powder mixtures for each of the layers. For example, tungsten precursors such as ammonium tungstate or molybdate can be dissolved in water and mixed with alumina powder (e.g. Baikowski CR 30, 15, 6, 1 powders of various mean particle sizes) at a predetermined ratio along with binders such as polyvinyl alcohol and/or polyethylene glycol. Sintering aids such as MgO (derived from magnesium nitrate that is soluble in water) for alumina can be included. Alternatively, fine W or Mo powder [e.g. type M-10 W powder with a mean particle size of 0.8 μm, or other types such as M-20 (1.3 μm), M-37 (3 μm) M-55 (5.2 μm), and M-65 (12 μm) from OSRAM SYLVANIA at Towanda, Pa.], can be mixed with alumina powder dispersed in water, and ball-milled (with e.g. alumina balls) to produce a uniform mixture. The resultant mixture can be spray-dried or pan-dried. The dried mixture is deagglomerated using a mill such as a vibrational mill to break down the soft agglomerates. In the case of metal precursors, the mixture is heated to a temperature (e.g. 1000° C. in hydrogen, or vacuum, or inert gas) where the precursor decomposes into metal particles.

The mixture powder is then loaded into a die with a core rod (designed to fit the diameter of the W or Mo tube or rod), and compacted (e.g. at 40 ksi) to a given green density. Powders for successive layers are prepared and added to the die one at a time, and then again compacted, until the final layer containing a high level of W is added. The entire assembly is compacted at 10 to 45 ksi, and ejected from the die. (The core rod could be designed to be stepped for the layers, such that the dimensional shrinkage of all the layers are compatible with the downstream processes for the formation of the top layer—W tube direct-bond as well as the formation of the bottom layer—PCA tube direct-bond.) The hollow-cylinder green body is then prefired at relatively low temperatures in hydrogen or vacuum or insert gas to remove the binders with essentially no dimensional shrinkage, and impart some strength for handling.

Figure 7:
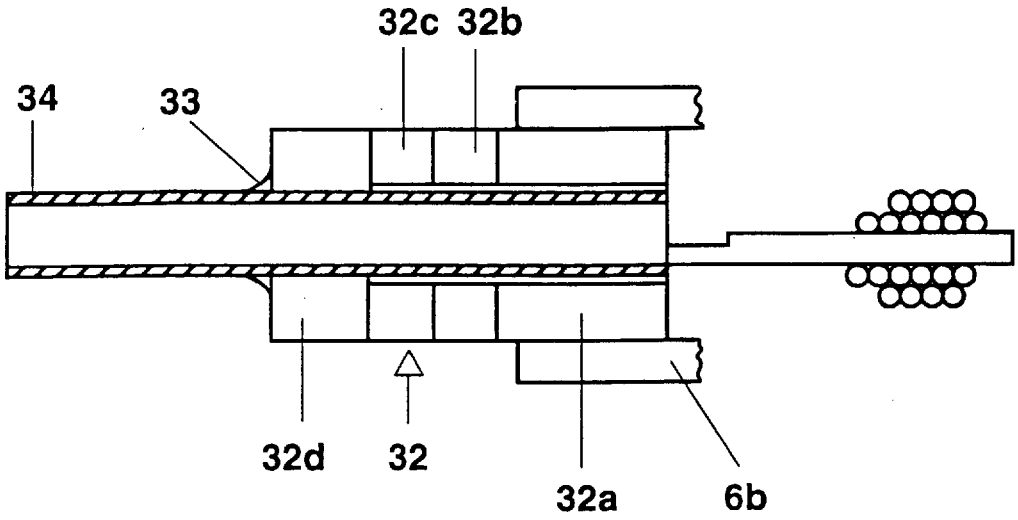
FIG. 7 is a detailed view on the second end of the arc tube, showing a forth embodiment of the invention.
Figure 10:
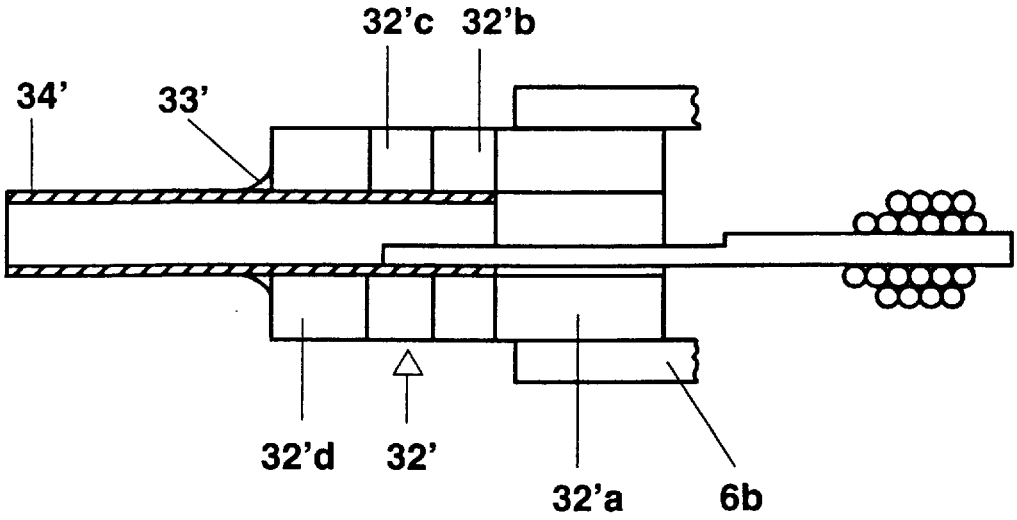
FIG. 10 is a detailed view on the second end of the arc tube, showing a sixth embodiment of the invention.

FIG. 10 shows a further embodiment which is similar to FIG. 7. It shows again the second vessel end of a 35 W metal halide lamp. The second, multipart plug 32' consists again of four axially aligned zones 32'*a* to 32'*d,* having the same composition as already explained in connection with FIG. 7.

However the molybdenum tube 34' acting as the second feedthrough is recessed and penetrates only to the three outer layers 32'*b* and 32'*d*. It is directly sintered to these three layers. The dimensions of this embodiment are as follows. The sintered thickness of the four layers are about 1.7 mm for the innermost zone 32'*a*, 0.5 mm for the adjacent intermediate zone 32'*b*, 0.4 mm for the second intermediate zone 32'*c* and 0.7 mm for the outermost zone 32'*d*.

Figure 11:
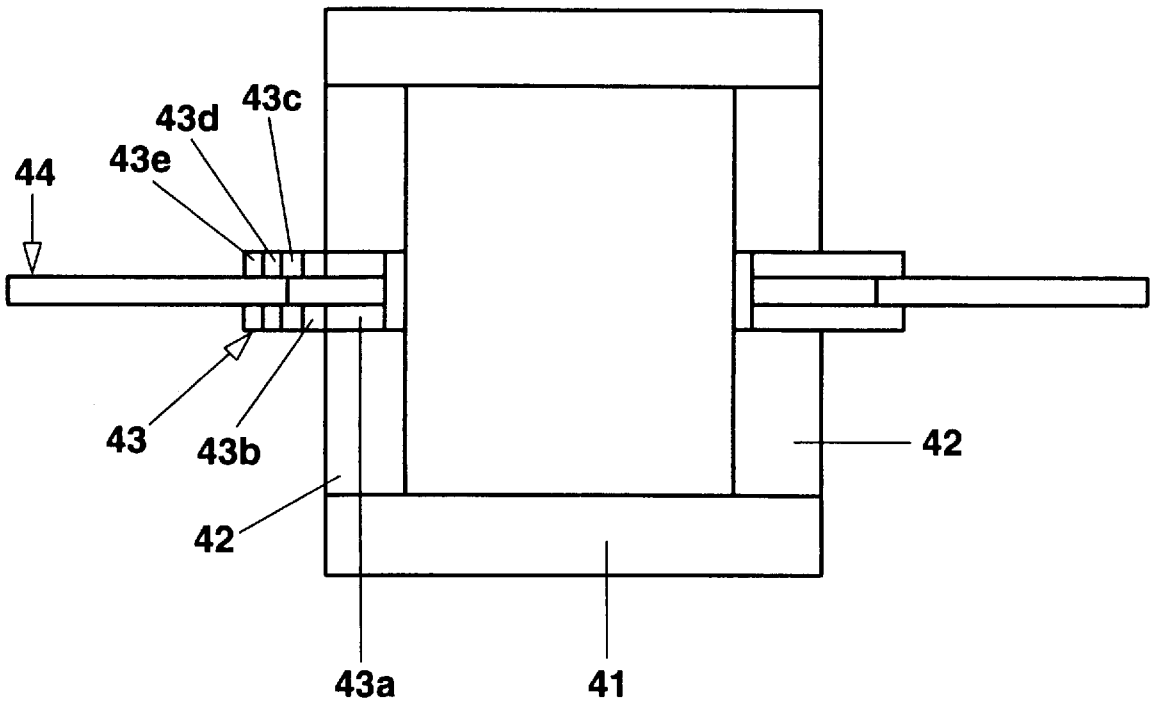
FIG. 11 is a view on a further, seventh embodiment of the invention.

FIG. 11 shows an embodiment with a PCA discharge vessel 41 whose ends are closed by disc-like insert members 42 made of PCA too. In a central bore of the insert member 42 a multipart structure 43 is arranged that consists of five zones of different composition. The cermet powders represent a graded cermet of the following sintered thickness: about 1.5 mm for the innermost zone 43*a* consisting of 10 wt.-% W, balance alumina with 800 ppm magnesia, about 0.6 mm for the adjacent intermediate zone 43*b* consisting of 30 wt.-% W, balance alumina with 800 ppm magnesia, 0.5 mm for the second intermediate zone 43*c* consisting of 50 wt.-% W, balance alumina with 800 ppm magnesia, 0.8 mm for the third intermediate zone 43*d* consisting of 70 wt.-% W, balance pure alumina, and 0.7 mm for the outermost zone 43*e* consisting of 90 wt.-% W, balance pure alumina. The graded cermet structure 42 was assembled and bonded with a molybdenum tube acting as a feedthrough 44 by firing at about 1500° to 1600° C. for about 1 to 2 hours in dry $H_2$. The feedthrough 44 penetrated to the three outer layers 43 *c–e*, but it had no contact to the two inner layers 43 *a* and 43*b*.

The first lock-in involved co-firing a first graded cermet-feedthrough system together with the discharge vessel 41 and the insert member 42 (having an outer diameter 6.5 mm, inner diameter 2.5 mm, with a length of 2.5 mm). The latter parts were formed by firing at about 1300° to 1400° C. for about one hour in wet $H_2$. The seal length between the multipart structure and the insert member was about 1 to 1.3 mm. The multipart structure was recessed for about 0.8 mm inside the insert member. This first lock-in firing produced one closed end structure. The other end was closed by inserting a second feedthrough-cermet-system into this end and performing a second lock-in. Then the whole assembly was final sintered in wet $H_2$ at about 1900° C. for some hours.

Figure 13:
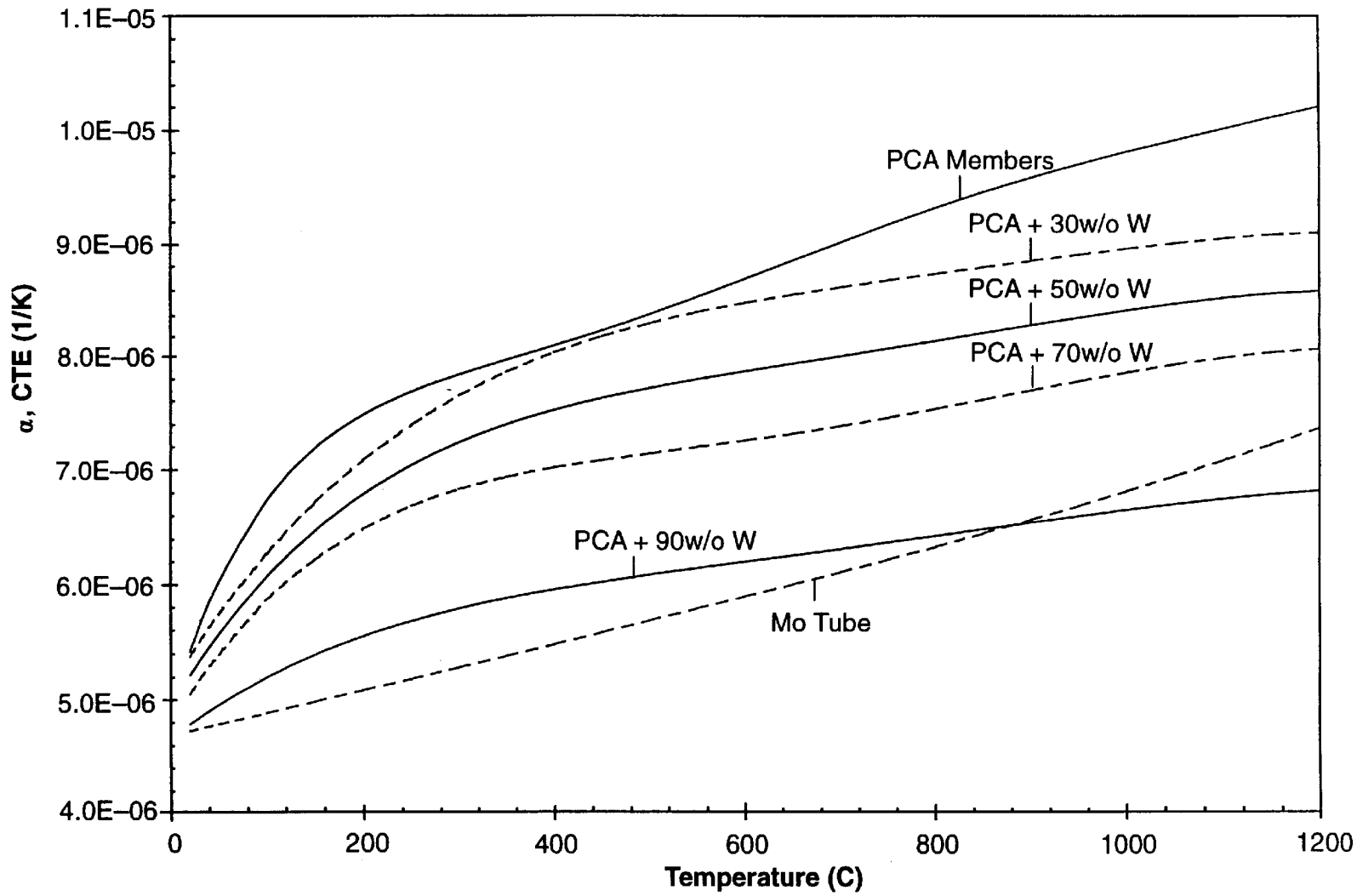
FIG. 13 is a diagram showing the coefficient of thermal expansion (CTE) in $K^{-1}$ versus temperature in degree Celsius.

In FIG. 13 the coefficient of thermal expansion is shown for the different parts of the multipart structure as well as for the PCA of the insert member and discharge vessel and for the molybdenum tube are shown. Assuming a typical operating temperature of the multipart cermet structure of 700° C. it can be seen that the difference between the thermal expansion coefficients of adjacent parts is about $1.0\times10^{-6}$/K.

Figure 12:
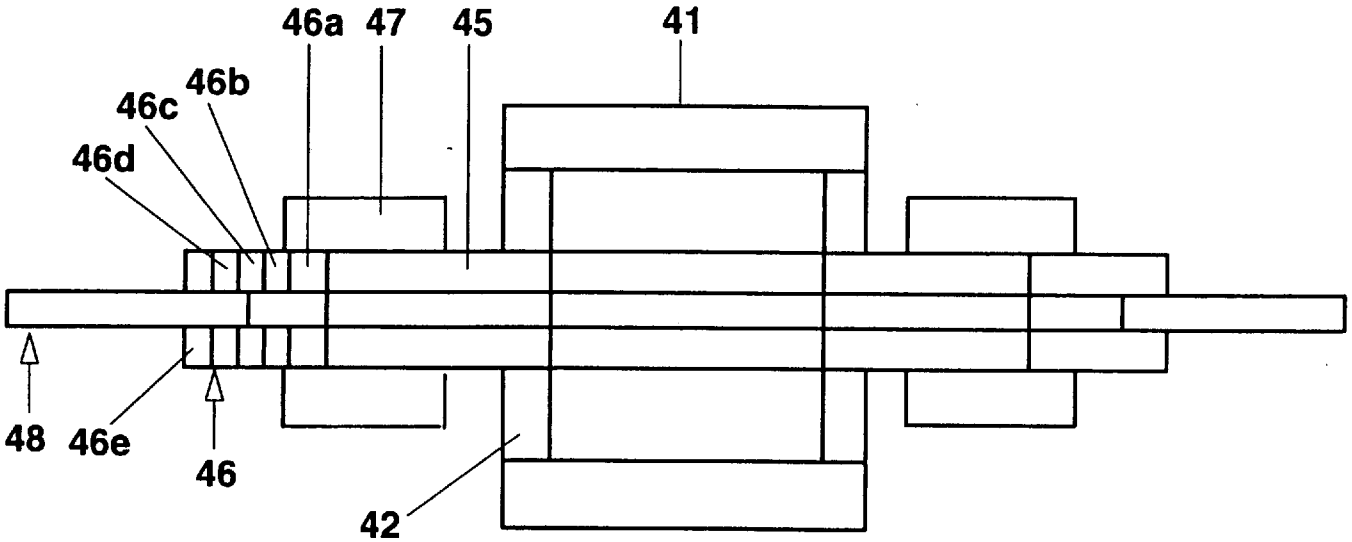
FIG. 12 is a view on a further, eighth embodiment of the invention.

FIG. 12 shows another preferred embodiment with reduced temperature load. Again a vessel 41 has at its ends disc-like inserts members 42. Both are made from PCA. The feedthrough system consists of three members. A homogeneous capillary 45 is inserted into a central bore of the insert member 42. The capillary 45 is prolonged by a multipart structure 46 which butts against it. The contact zone between them is surrounded by a PCA bushing member 47. The feedthrough 48 is a molybdenum tube.

The structure 46 is a multipart cermet consisting of five (or four) layers. The innermost layer 46*a* contains 10 wt.-% tungsten and has a length of 1.7 mm. The first adjacent intermediate layer 46*b* contains 30% tungsten and has a length of 0.7 mm. The second intermediate layer 46*c* contains 50% tungsten and has a length of 0.5 mm. The balance in each case is alumina with 800 ppm magnesia. The third intermediate layer 46*d* contains of 70% tungsten and has a length of 0.8 mm. The outermost layer 46*e* contains 90% tungsten and has a length of 0.7 mm.

The feedthrough tube 48 only penetrated to the three outer layers 46 *c–e*, but had no contact to the inner layers 46*a* and 46*b*. An electrode system (not shown) is attached to the inner end of the feedthrough 48. The feedthrough is closed in accordance with well known techniques. These features are disclosed in the prior Art cited above.

The procedure for fabrication of this embodiment is as follows. The first lock-in firing involved co-firing the graded cermet together with the feedthrough and the prefired bushing. The bushing had an outer diameter of 5.3 mm and an inner diameter of 3 mm. It was about 5 mm long. The bushing was prefired at about 800° to 900° C. for some hours.

The lock-in firing was performed at a temperature of about 1100° to 1200° C. for at most one hour in wet $H_2$. The seal length (in the sintered state) between the graded cermet and the bushing was about 1.5 mm. The graded cermet was recessed for about 2.5 mm inside the bushing. The first lock-in firing produced one end structure.

The firing temperature for the lock-in of the cermet with the bushing was selected so that, after the co-firing, the inner diameter of the bushing would fit the capillary outer diameter of 2.8 mm. The capillary and the vessel and insert member have already been finally sintered to an assembly. Two already first locked-in parts were then assembled with the capillaries at both ends of the vessel. The entire unit was final sintered in wet $H_2$ at high temperature (about 1800° to 1950° C.) for at most 30 minutes to result in a hermetic bond between the capillary and the cermet by means of the bushing.

In FIG. 9 a pressing technique for manufacturing axially graded cermets is shown.

Figures 9A, 9B, 9C:
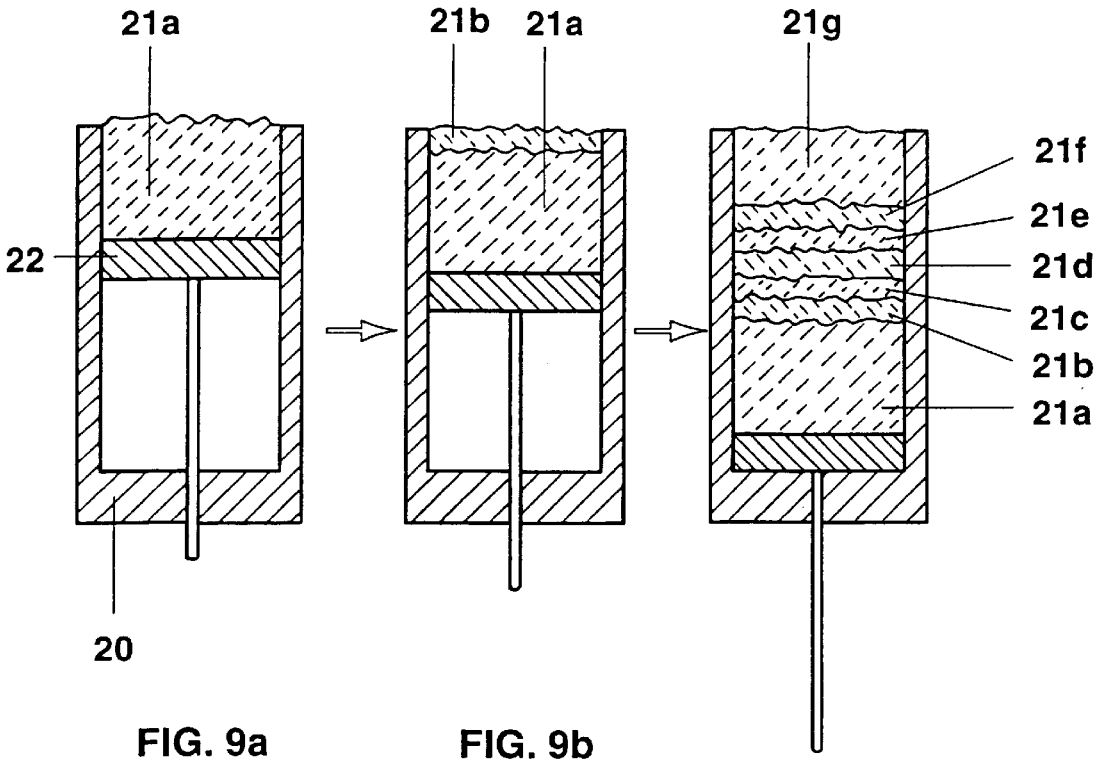
FIG. 9 is a scheme of the manufacturing steps for a axially graded cermet by using the pressing technology.

In a first step (FIG. 9*a*), a cylindrical pressing form 20 is filled with a pure alumina suspension 21*a*, made with organic binder like "PVA". After withdrawing the piston 22 for a certain amount, the next suspension 21*b*, consisting for example of 90% alumina and 10% tungsten is filled in the form 20 (FIG. 9*b*). This procedure is repeated several times until the last suspension (sixth layer 21 *g* in FIG. 9*c*) is filed. The latter one consists of 60% alumina and 40% tungsten, for example and its thermal behavior matches that of the tube. During filling the piston is moved downward step by step.

Figures 9D, 9E, 9F:
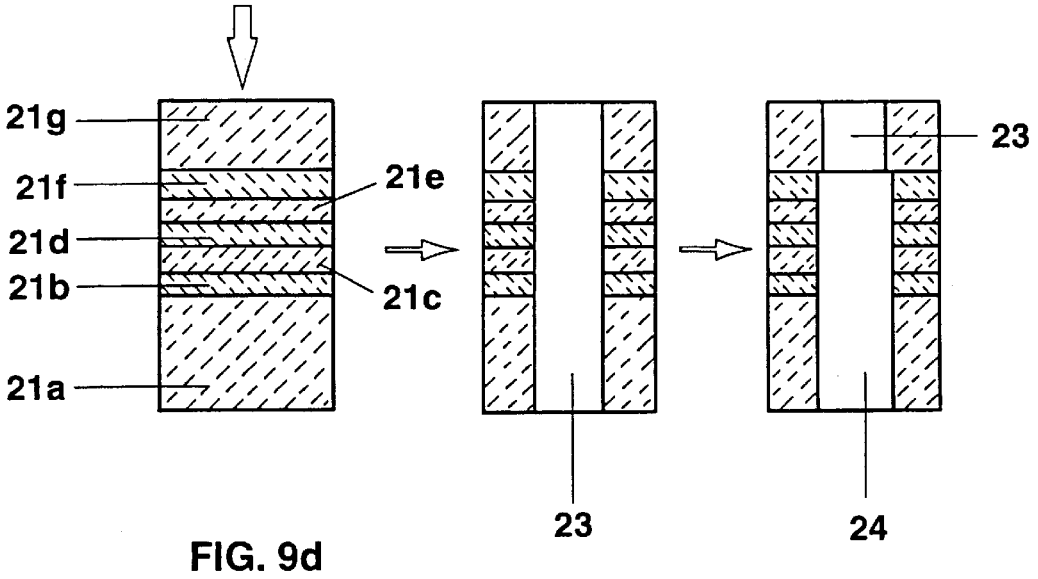

Then (FIG. 9*d*) pressing of the cermet plug is conducted by means of an additional piston (arrow). Thereafter, a hole 23 is drilled into the "green" cermet, comprising a suitable diameter by which the optimum shrinking ratio of the cermet against the molybdenum tube (to be inserted into hole 23) is achieved (FIG. 9*e*). Then the plug is prefired.

Alternatively, cermet powders were loaded in the sequence of 70 wgt. % W, 50 wgt. % W, 30 wgt. % W, 20 wgt. % W and 10 wgt. % W, into a die containing a core rod. Each powder was loaded, and roughly leveled, in the die, successively. The upper and lower punches were applied after all layers were loaded. A uniaxial pressure of 40 ksi was applied. The punches were then removed, and the compacted cermet was released from the core rod. The ID of the cermet disc can further be drilled so tht the inner layers 21*a–f* are slightly larger than the ID of the outer layer 21*g*.

For the embodiments with the feedthrough penetrating all zones of the graded cermet an additional step is necessary: To prevent a tight contact between the molybdenum tube and the zones 21*a–f* of the multipart structure or plug not matching the thermal behavior of the metal tube (in contrast to zone 21*g*) these five zones are drilled a second time using a drill diameter being a little bit larger than the first time (FIG. 9*f*). The resulting widened hole 24 provides a gap after insertion of the feedthrough which has to be as small as possible (typical 50 $\mu$m) in order to prevent condensation of the filling inside the gap. It is only then that the plug is prefired.

The W or Mo tube or rod is inserted in the hole of the prefired, multi-layer, hollow, cylindrical cermet. The accomplished unit plug/feedthrough with the gap 14 can be seen in FIG. 2, for example.

The feedthrough/plug assembly is prefired (1200°–1500° C.), or prefired and sintered, in hydrogen, at relatively high temperatures (e.g. 1800°–2000° C.) to produce a predetermined interference bond (e.g. 4 to 18%) between the top layer (which has a high level of W or Mo) and metal feedthrough. During the firing, the top layer is shrunk against the W tube or Mo rod, respectively, so as to form a fritless, hermetic bond. It is important to design the dimensional shrinkage (through optimization of the particle sizes of the metal and alumina phases, and the compaction pressure) of all the layers with respect to the clearance between the W/Mo part and the green or prefired multilayered cermet, so that the formation of the interference bond between the top layer and W/Mo part is not obstructed by other layers.

The prefired and sintered cermet-feedthrough assembly can be optionally HIPed (hot-isostatically-pressed) at high temperatures (e.g. 1800° C.) to produce fully dense bodies. The sintered or HIPed W/Mo feedthrough-graded cermet plug member is then placed inside a prefired PCA tube, or inside the shank portion of a prefired, elliptically-shaped PCA tube.

The PCA can be made by prefiring (1000°–1500° C.) a green body of alumina powder doped with sintering aids such as MgO, MgO plus zirconia, or MgO plus erbium oxide. Both ends of the prefired PCA envelope have the densified feedthrough-graded cermet bodies placed at a predetermined distance. During sintering of the entire assembly in hydrogen or nitrogen-hydrogen at 1800°–2000° C., the PCA tube densities to translucency and dimensionally-shrinks to accomplish (1) an interference bond between the bottom layer of the multipart plug (has a low level of metal phase) and the PCA tube, and (2) a specified cavity length between the tips of the opposing electrodes. If, at one end of the PCA, the W/Mo feedthrough is a rod, this sintering process produces a one-end-closed envelope ready for dosing. The degree of the interference for the direct bond between the bottom layer of the cermet and PCA during co-firing is determined by the clearance between them, prefiring temperature used, and sintering shrinkage.

Lamp fills including various metal halides and fill gas can then be added to the envelope through the Mo/W tubular feedthrough at one end of the feedthrough-cermet enclosure. Mo/W tubes can finally be sealed using a laser (Nd—YAG or $CO_2$) welding technique so as to accomplish the entire arc envelope made of PCA (enclosed by a graded cermet) equipped with halide-resistant Mo/W feedthroughs.

A preferred embodiment is a hat type configuration for the bottom layer. The prefired cermet-feedthrough can then be mounted on one open end of a PCA tube (prefired or already sintered to translucency), and the entire assembly is brought to high temperatures to form the shrunk-bond between the top layer and W/Mo, and the bottom layer and PCA, simultaneously.

It is obvious that an insulating coating such as pure alumina can be applied to the inside surface of the cermet enclosure so as to prevent arcing between the plasma column and cermet, that can cause darkening and leakage.

In order to further amend gas-tightness of such a seal a frit can be applied to the outer surface (remote from the discharge) of the top layer (in case of axially graded seal) or outermost layer (in case of radially graded seal) respectively.

An essentially preferred PCA arc tube is made from alumina doped with about 500 ppm MgO and, possibly, in addition with about 350 ppm $Y_2O_3$. Preferably, the grain size of such a ceramic is as small as possible (below 1 $\mu$m) to improve mechanical strength.

The feedthrough, especially if tubular, is either flush or preferably recessed with the inside surface (facing the discharge) of the plug.

It is advantageous to shorten the length of the bond between the innermost/bottom layer and the PCA arc tube as good as possible. A good estimate is to chose a length of the bond interface which is as small as the wall thickness of the PCA arc tube.

Of course the principles of this invention can be directed to another scenario using an arc tube with another ceramic type (for example $Y_2O_3$) together with other cermet materials.

Of course, instead of using an integral end portion of an arc tube a separate ceramic ring-like end member can be used.

Preferably, only the innermost bottom zone of the multipart plug is inserted into the end portion of the arc tube. This requires a long enough axial length of the bottom zone.

The inventive design effectively produces a smooth gradient in thermal expansion of the cermet thus bridging PCA arc tube and metal feedthrough. This is required in order to minimize thermal stresses incurred during the cooldown portion of the fabrication cycle of the plug-feedthrough assemblies, as well as during lamp on-and-off operation cycles.

The radially graded cermet end plug can be made by several techniques including pressing, and spraying.

Pressing can form the axially multi-layer structure. Alumina-metal (Mo/W) powder mixture can be made by ball-milling an aqueous suspension of alumina and metal powders along with organic binders such as polyvinyl alcohol and/or polyethylene glycol. Metal precursors such as ammonium tungstate can be dissolved in water added with alumina powder. The ball-milled slurry can be pan-dried or spray-dried. If metal precursor is used, the mixture requires pyrolysis at high temperatures (e.g. 1000° C.) to form metal particles. If metal powder is used, the dried mixture for the innermost layer can be added to a die having a core rod. The core rod is then removed and replaced with a smaller core rod. The powder mixture designed for the next layer is added to the cavity between the core rod and the die. Repeating of the above loading operation with successive powder mixtures followed with a final compaction, results in a final green body consisting of multiple layers packed in the axial direction. The green structure can then be ejected, and prefired at relatively low temperatures (1000°–1500° C.) in vacuum, hydrogen, or argon to remove the binder. During the prefiring, the inner diameter of the cermet may shrink 0–10% depending on the prefiring temperature. It is important to select the starting alumina and metal powders of appropriate particle sizes, and the solids loading in the slurry, so that the multi-layers shrink uniformly.

Spraying is another method to form the axially multilayer structure. Alumina-metal (Mo/W) powder mixture can be made by ball-milling an aqueous suspension of alumina and metal powders along with organic binders such as polyvinyl alcohol, polyethylene glycol, or polyox. Metal precursors such as ammonium tungstate can be dissolved in water added with alumina powder. The ball-milled slurry can be sprayed onto a rotating, porous, slightly oversized, polymeric mandrel that is heated. Spraying can be accomplished using a two-jet, ultrasonic, or electrostatic atomizer. The binder content and solids loading of the slurry are selected such that the aqueous mixture sticks to and deposits on the W/Mo tube/rod, much like spraying of phosphors slurry onto the inside of a fluorescent lamp's glass tube. Heating the mandrel slightly during the spraying process may be beneficial to a stronger adhesion of the powder mixture to the metal and cohesion of the powder mixture itself. Spraying and deposition of successive layers is conducted with slurries of decreasing metal content (as the mandrel traverses axially) so as to form an axial gradient. The thickness of the layers can be as thin as 0.01 mm in accordance with Watanabe and Kawasaki, cited above.

The green body can be cold isostatically pressed, and then prefired at relatively low temperatures in hydrogen, nitrogen-hydrogen, or vacuum to burn-out the mandrel and remove the binders to produce an axially graded cermet. During the prefiring, the ID of the cermet may shrink 0–10% depending on the prefired temperature. It is important to select the starting alumina and metal powders of appropriate particle sizes, the solids loading in the slurry, and the pressure of the cold isostatical pressing step, so that the multilayers shrink coherently.

The W/Mo tube/rod is then placed in the center hole of the prefired, axially graded cermet. The whole assembly is heated to high temperatures (1800° to 2000° C.) in hydrogen or nitrogen-hydrogen to (1) cause the cermet to sinter, and (2) form the interference bond between the metal feedthrough and cermet. The degree of interference is typically 4–10%, depending on the dimensional shrinkage during sintering and the clearance between the ID of the prefired cermet and the OD of the metal feedthrough. The sintered cermet-feedthrough assembly can be optionally HIPed at high temperatures to further decrease residual pores.

The sintered cermet-feedthrough assembly is placed inside a prefired PCA straight tube or inside the straight portion of a prefired elliptically-shaped PCA bulb. The PCA consists of alumina, preferably doped with MgO, or MgO plus zirconia. The entire assembly is sintered in hydrogen or nitrogen-hydrogen to density PCA to translucency. During sintering, the PCA shrinks against the OD of the cermet to form an interference bond. The degree of the interference in the direct bond depends on the shrinkage of the PCA and the clearance between the cermet and the ID of the prefired PCA. Both ends of the prefired PCA should have the sintered cermet-feedthrough so that, upon sintering of the PCA, the spacing between the electrode tips is shrunk to a specified cavity length for the lamp. If the feedthrough of the sintered end structure located an one end of the PCA is a rod, the PCA sintering step produces an one-end-closed envelope containing hermetically sealed feedthroughs ready for dosing.

It is possible to simultaneously accomplish the interference bonds between the outermost layer and W/Mo tube, and the innermost layer and PCA, in a one-step sintering in which the prefired graded cermet consolidates to nearly full density, and PCA sinters to translucency.

Lamp fills including various metal halides, mercury, and fill gases can then be added to the envelope through the Mo/W tubular feedthrough at one end of the feedthrough-cermet enclosure. Mo/W tubes can finally be sealed using a laser (Nd—YAG or $CO_2$) welding technique so as to accomplish the entire arc envelope made of PCA (enclosed by graded cermets) equipped with halide-resistant Mo/W feedthroughs, FIG. 1. This technique is well-known.

The last layer of the second plug when being weldable can be electrically conductive or electrically non-conductive.

We claim:

1. A ceramic envelope device for a high pressure discharge lamp comprising:

a translucent ceramic tube having a first end and a second end, the tube confining a discharge volume and defining a longitudinal axis a first at least essentially electrically non-conducting cermet end plug, said first plug closing said first end of the ceramic tube a second at least essentially electrically non-conducting cermet end plug, said second plug closing said second end of the ceramic tube at least said second plug having a multipart structure with at least three parts a first and second metal feedthrough passing through the first and second plug respectively, each feedthrough having a inner and outer end, respectively, said feedthroughs being made from one of the group of the metals tungsten, molybdenum and rhenium and alloys from at least two of these metals two electrodes located at the inner end of the first and second feedthrough respectively the coefficient of thermal expansion of at least one part of the multipart plug being between those of the arc tube and the feedthrough wherein said multipart plug comprises at least four axially aligned parts with different coefficients of thermal expansion, including a first and a last part, the first part being innermost with respect to the discharge volume and the last part being outermost with respect to the discharge volume the multipart plug is directly sintered both to the arc tube and the feedthrough in that manner that the first part of the multipart plug is directly sintered to the arc tube and the last part of the multipart plug is directly sintered to the related feedthrough.

2. A ceramic envelope device according to claim 1, wherein the composition of the different parts differs in the proportion of the metal.

3. A ceramic envelope device according to claim 1, wherein the composition of the different parts uses different constituents.

4. A ceramic envelope device according to claim 1, wherein said plug is a layered cylindrically shaped structure with a central bore, at least the outermost, last layer adjacent the second feedthrough being in gas tight contact with said feedthrough.

5. A ceramic envelope device according to claim 4, wherein only the outermost layer is in gas tight contact with said feedthrough, and the distance between said feedthrough and the layers of the second plug (except the last layer) is at least 1 mm.

6. A ceramic envelope device according to claim 4, wherein the feedthrough is recessed within the plug and penetrates only some, but not all zones or layers, starting from the outermost layer.

7. A ceramic envelope device according to claim 5, wherein the distance between the layers and the second feedthrough decreases telescope-like or smoothly curved with increasing distance of the layer from the discharge volume.

8. A ceramic envelope device according to claim 1, wherein only the innermost layer is at least partially located in the end of the arc tube.

9. A ceramic envelope device according to claim 1, wherein the second plug consists of at least five axially located parts.

10. A ceramic envelope device according to claim 1, wherein the first innermost part of the second plug has a "top hat" structure.

11. A ceramic envelope device according to claim 1, wherein the second feedthrough is tubular.

12. A ceramic envelope device according to claim 1, wherein the vessel end is closed by a disc-like insert member having a central bore for the multipart structure, and preferably the multipart structure is recessed within the insert member.

13. A ceramic envelope device according to claim 1, wherein the last, outermost part of the second plug has an amount of metal of at least 50 vol.-%.

14. A ceramic envelope device according to claim 13, wherein the last, outermost part of the second plug is weldable.

15. A ceramic envelope device according to claim 14, wherein the second feedthrough is welded to the last, outermost part of the second plug.

16. A ceramic envelope device according to claim 12, wherein a separate filling hole or bore is located in the second plug.

17. A ceramic envelope device according to claim 16, wherein a stopper made from weldable material fits into the filling hole or bore.

18. A ceramic envelope device according to claim 17, wherein the stopper is welded to the outer surface of the last part of the second plug.

19. A ceramic envelope device according to claim 1, wherein the ceramic material of the arc tube consists of alumina doped with magnesia and possibly in addition with yttria.

20. A ceramic envelope device according to claim 1, wherein the material of the graded cermet body is made from pure alumina for at least the outermost zone and alumina doped with magnesia for at least the innermost zone.

21. A ceramic envelope device according to claim 1, wherein said multipart structure is connected at its side facing the discharge to a hollow member, and the connection zone is surrounded by a bushing.

22. A ceramic envelope device according to claim 1, wherein said first plug is a one-part body or a multipart body similar to said multipart plug.

23. A ceramic envelope device according to claim 1, wherein the difference between the coefficients of thermal expansion for adjacent parts of the multipart structure (including the arc tube and the related feedthrough) is about $1{,}0\times10^{-6}$/K.

24. A lamp with a ceramic envelope according to claim 1.

* * * * *